United States Patent [19]

Gigli

[11] Patent Number: 4,671,023

[45] Date of Patent: Jun. 9, 1987

[54] AERATED GRATE COVERING DEVICE FOR THE SHELTERING FROM SUN AND RAIN WITH MANUAL AND/OR AUTOMATIC CONTROL

[76] Inventor: Mario Gigli, Via della Farnesina, 149, 00194 Roma, Italy

[21] Appl. No.: 703,372

[22] Filed: Feb. 20, 1985

[30] Foreign Application Priority Data

Feb. 29, 1984 [IT] Italy ..... 47774 A/84

[51] Int. Cl.[4] ..... E04H 14/00; E06B 7/08

[52] U.S. Cl. ..... 52/1; 52/473

[58] Field of Search ..... 52/1, 473; 47/17

[56] References Cited

U.S. PATENT DOCUMENTS

| | | | |
|---|---|---|---|
| 1,163,663 | 12/1915 | Hawkins | 52/1 |
| 3,521,546 | 7/1970 | Day | 52/1 |
| 4,144,802 | 3/1979 | Babin | 52/1 |

*Primary Examiner*—William F. Pate, III
*Assistant Examiner*—Michael Safavi
*Attorney, Agent, or Firm*—Beveridge, DeGrandi & Weilacher

[57] ABSTRACT

The covering device consists in an aerated grate comprising tabs AL with an automatic and manually controlled rotation angle according to the intensity of rain and/or snow or wind.

Tabs AL have a semitubular base profile 1, a baffle plate 2, a dripping plane 3, a vertical wall or plane 4, and a plurality of intermediate planes 5 with upper portions 5A, having bounce-preventing and gutter functions to collect rain in a double gutter frame 7, which rain water is then led into a reservoir 21 which will, due to the increasing weight thereof, lift a counterweight 9 to cause the automatic closing of tabs AL.

Alternatively, the tabs may be closed by operating manual lever 16 or by means of a wind operated automatism having an aerodynamic plane 27 being provided with a limit stop rotation angle to allow it to recede from the wind.

8 Claims, 5 Drawing Figures

AERATED GRATE COVERING DEVICE FOR THE SHELTERING FROM SUN AND RAIN WITH MANUAL AND/OR AUTOMATIC CONTROL

The present invention concerns an aerated grate covering device for the sheltering from sun and rain with a manual and/or automatic control comprising movable tabs acting like a bounce-preventing turbulence gutter.

Some covering structures for domestic and industrial use are already known, which allow both the ventilaton of, and the passage of light to, but at the same time prevent the fall of rain and snow on the room below.

Belgian Pat. No. 538893 discloses a cantilever roof provided with openings to allow the passage of air and dim light but not of direct solar light.

Said openings further show rather closed profiles, which allow the passing of a minumum quantity of air and light and do not assure any sealing in case of heavy rain.

A further relevant disadvantage of the above-mentioned patent is the absolute lack of adjusting possibilities.

The structure of the cantilever roof shown in the review "Alluminium Suisse," 6 (1956.03) 2.59, also cuts out any possibility of complete closing.

It is an object of the present invention to provide a covering device for ambients requiring ventilation, full sun radiation and complete protection from rain and snow, which covering device is adjustable by means of a manual and/or automatic control according to the intensity of the wind and/or rain.

Such object is achieved by a covering device according to the present invention, which comprises an aerated grate consisting in a plurality of tabs, each tab including a semitubular base profile, baffle plates, a dripping plane and bounce-preventing intermediate planes, such tabs being housed in the holes of the central wall of a double gutter frame and characterized in a coupling bar connected to the upper end of each tab and, by means of tension rods, to two balanced rotation transmission levers. A reservoir is provided wherein the reservoir is fed by rain or the like and has a lower outlet hole for the adjusting of the filling according to the feeding capacity, the reservoir sliding in a vertical duct so as to cause, due to the increasing weight thereof, the lifting of a counterweight for the closing of the tabs, thus also preventing the passing of moist air into the room below.

The advantages obtained by means of the present invention mainly consist in the fact that the tabs allow the direct passage of light and provide for air circulation due to natural draft with a consequent temperature lowering of the covering, even in the presence of strong solar radiation, and show the maximum protection from drops divided by the bounce at the first impact.

Where the present invention is applied as a ventilation grate for underground rooms, it provides higher percentage of air-passing surface than the structure described in the aforementioned review "Alluminium Suisse."

The present invention will be described in more detail hereinbelow according to the attached drawings showing a preferred embodiment.

Figure 1:
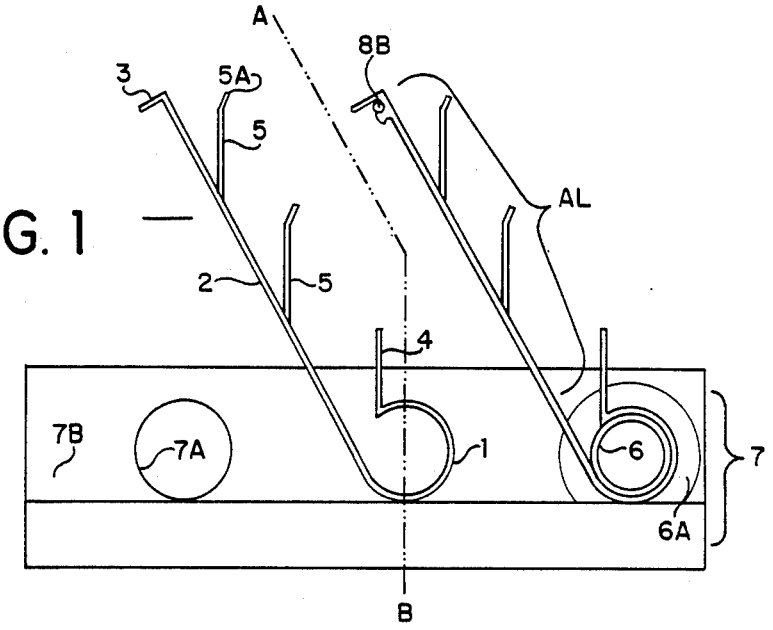
FIG. 1 shows a square section of the movable tabs.
Figure 2:
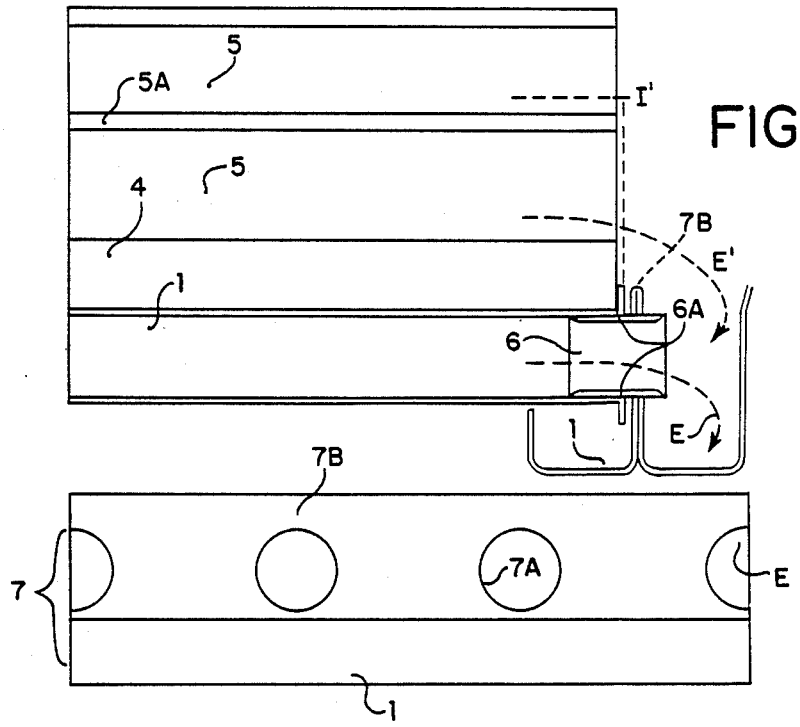
FIG. 2 shows section A-B according to FIG. 1.

The Figures show an aerated grate covering device for the sheltering from rain and sun with a manual and/or automatic control comprising tabs AL, characterized by a semitubular base profile 1, a baffle plate 2, a dripping plane 3, and a vertical wall 4 provided with a plurality of intermediate planes 5, slightly inclined at their upper portions 5A, so as to prevent water from bouncing and flowing out of the semitubular base profile 1.

Tabs AL, through bushings 6, fixed to the end of base profile 1, are housed in holes 7A of a central wall 7B of a double gutter frame 7, said gutter has an inner part I and an outer part E, and in an equispaced manner, form together with further side by side elements a rotating grate panel of any desired dimensions.

Bushings 6 are provided with a shim adjustment ring nut 6A which, adhered to the end of base profile 1, also functions as a dripper in the inner gutter of frame 7.

A coupling bar 8 with holes 8A, in the same plane as holes 7A of frame 7, provides, by means of pins 8B fixed at the angle between baffle plate 2 and dripping plane 3, for the symmetrical rotation of all tabs AL of the grate on bushings 6.

A counterweight 9 fixed onto a lever 10 hinged at pivot point 11 to frame 7, selectively causes said lever 10 to pass from a horizontal to a vertical position in order to move coupling bar 8 by means of small transmission lever 12 and tension rod 12A along the whole of the rotation angle of tabs AL.

An arm of lever 13, having its fulcrum at pin 14 in frame 7, is manually movable by means of tension rod 15 of lever 16. Manual lever 16 is provided with stop teething 35 to selectively limit the run of lever 10 to thereby position tabs AL, according to the needs for ventilation and sun protecton.

A lever 17, having its fulcrum at pin 18 in frame 7, is connected to coupling bar 8 by means of a small transmission lever 19 and a tension rod 20 to lift a reservoir 21 provided with an outlet hole 21A. Reservoir 21 is slid upwardly and downwardly in a duct 22 by means of a tension rod 23.

A tubular support 24 vertically attached to the end of a lever 13, supports at the upper part thereof and by means of a thrust bearing bushing 25, a vertical bearing plane 26 and an aerodynamic push mobile plane 27, transversally oriented with respect to plane 26. Plane 27 is supported by a lever 28 having its fulcrum at pin 29 and transmission lever 30. A small flexible cable 31 extends over pulley 32 and through the body of support 24 to connect lever 30 to lever 13. Lever 13 is provided with a rotatable connector 33.

Manual control over the device of the present invention is provided by lever 16 which, according to the different positions it may assume due to rod 15 and lever 13, controls the upward and/or downward movement of weight 9, fixed to lever 10, so that weight 9, by means of levers 10 and 12, and tension rod 12A, varies the inclination of baffle plates 2, connected to coupling bar 8, from complete closure (corresponding to the sun protection function) to an intermediate inclination or to a fully open position.

The water vertically falling onto dripping plane 3 of baffle plate 2 will be led towards baffle plate 2 of an adjoining tab AL as well as into gutters E and I formed by each baffle plate and its respective bounce-preventing, intermediate planes 5.

The water falling below will be led by baffle plate 2 from vertical wall 4 into base gutter 1.

The double gutter frame 7, with inner gutter I, collects the water laterally falling from upper tabs AL passing onto dripping ring nuts 6A, while outer gutter E receives, through bushings 6, the water coming from base profile 1.

A part of the water collected from the frame of gutters 7 will be led, by means of tube 40, into reservoir 21 which, if the feeding capacity thereof exceeds the drainage capability of the outlet hole 21A thereof, will fill up so that its weight will increase and exceed the weight of counterweight 9 to thus completely close tabs AL and thereby prevent the passage of moist air to below the grate.

Figures 3, 4, 5:
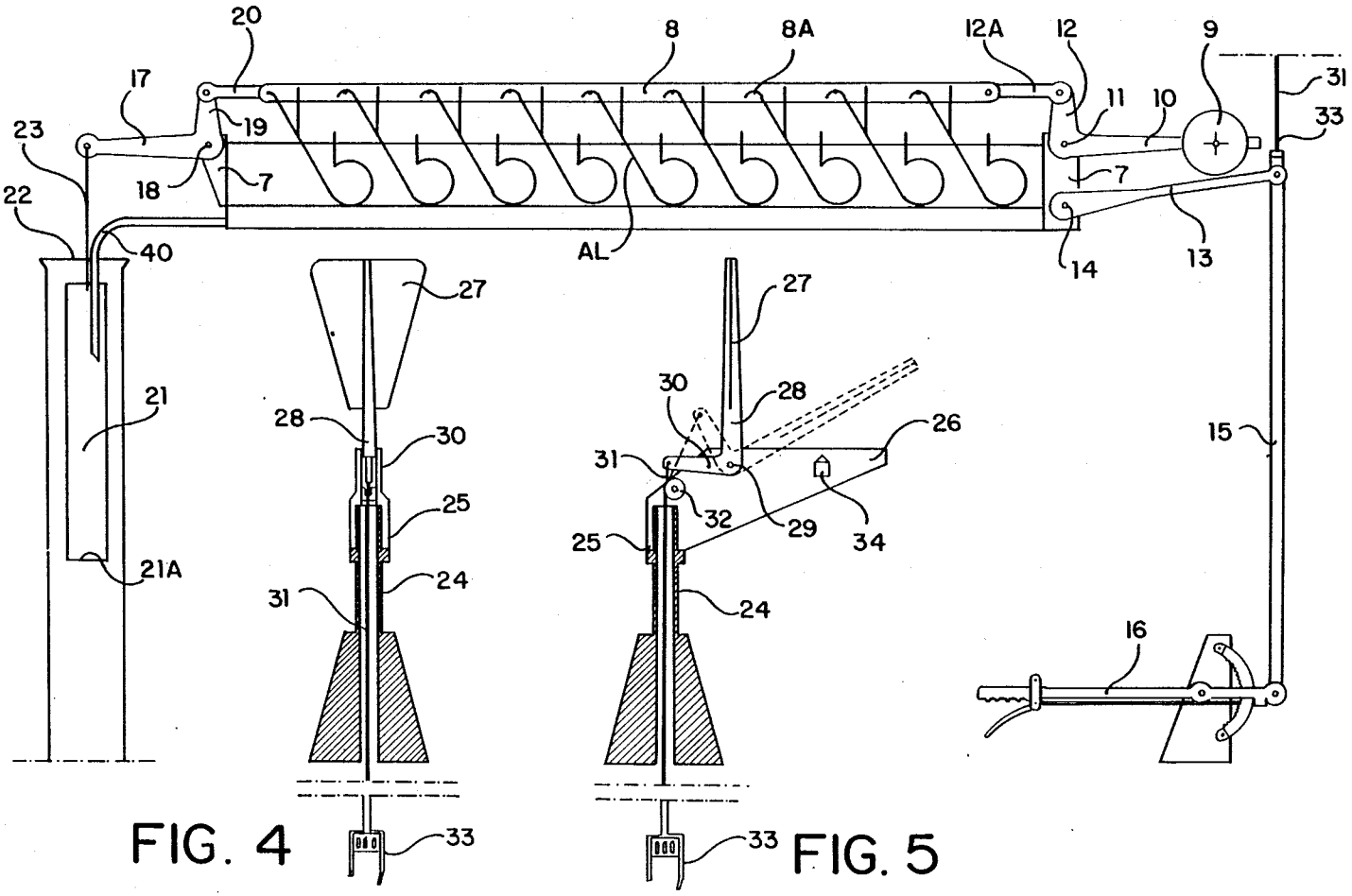
FIG. 3 shows a lateral scheme of the whole device.
FIGS. 4 and 5 show front and lateral views, respectively, of the automatic closing mechanism of the covering according to the wind intensity.

Further, according to the present invention, the device automatically responds to particularly strong wind. Wind force against aerodynamic plane 27, oriented by plane 26, causes rotation of lever 28. Then transmission lever 30 pulls cable 31 as illustrated by the dotted lines in FIG. 5 so that cable 31 lifts rod 15 which, in turn, causes weight 9 to be lifted to close tabs AL.

It is evident that aerodynamic plane 27 assumes a horizontal position at the end of its pivotal path so that it will offer no more resistance to the strong wind.

In summer, the grate according to the present invention may be sprinkled with water (artificial rain) so as to obtain a fresh room below.

An aerated grate covering device, for the sheltering from sun and rain with manual and/or automatic control includes a panel consisting in equidistance tabs (AL), comprising a semitubular base profile (1), a baffle plate (2), a dripping plane (3), a stress plane (4) and bounce-preventing intermediate planes (5), housed in holes (7A) of central wall (7B) of a double gutter frame (7), having an inner gutter (1) and an outer gutter (E), and comprising a coupling bar (8) determining, by means of pins (8B) fixed at the angle between baffle plate (2) and dripping plane (3), the symmetrical rotation onto bushing (6) of all tabs (AL) and comprising a reservoir (21) and sliding in vertical duct (22), connected by a tension rod (23) to a transmission lever (19) so as to determine, with the weight increase thereof, the lifting of a counterweight (9) and the closing of saids tabs (AL).

Such an aerated grate covering device further comprises a lever arm (13) having its fulcrum in a pin (14) out of one piece with frame (7), manually moved by means of the tension rod of lever (16) to graduatable stops so as to limit the run of a lever (10) and determine the position of tabs (AL) as well as the starting rain protection automatism angle thereof.

Also, the grate covering device is characterized by a semitubular base profile (1) of tabs (AL) with bounce-preventing turbulence gutter functions.

It is also characterized in that the number of bounce-preventing intermediate planes (5) is related to the height of baffle plate (2).

It further comprises a bushing (6) with a central shim adjusting ring nut (6A) which functions as a dripper for semitubular base profile (1) of tabs (AL).

It also comprises a frame (7) with a double gutter (I) and (E), with a central wall (7B) for supporting the semitubular profile (1) section of tabs (AL).

The aerated grate covering device comprises a coupling bar (8) which is respectively connected with pins in holes (8A) to the upper end of tabs (AL) and with the ends thereof, by means of tension rods (12A and 20), to transmission levers (12 and 19) with balanced rotation.

The aerated grate covering device further has a lower outlet hole (21A) in reservoir (21) to adjust the filling thereof according to the feeding capacity.

The aerated grate covering device further comprises an aerodynamic plane (27) suported by lever arm (28), with a limit stop rotating angle receding from the wind so as to obtain the wind operated automatism.

What is claimed is:

1. An automatically controlled aerated grate covering device for the sheltering from sun and rain, said grate covering device also being adapted for manual control thereover, said device comprising:

a plurality of tabs arranged in equispaced planes, each of said tabs including a semitubular base, a baffle plate connected to said base and extending tangentially therefrom, a plurality of intermediate plates attached to said baffle plate in spaced-apart relationship, a wall connected to said base and extending outwardly therefrom, and a dripping plate attached to the free end of said baffle plate;

a gutter frame having a corresponding plurality of holes, said tabs being rotatably received within said holes;

a coupling bar having two ends, said bar connecting said tabs and extending transversely thereof for simultaneously rotating said tabs, each of said tabs having a pivot pin located near the attachment of said dripping plate to said baffle plate, said pin being engaged by said coupling bar to connect said tabs;

a reservoir having a fluid intake and fluid outlet, said reservoir being slidably received within a duct;

conduit means for conducting fluid from said gutter frame to said fluid intake of said reservoir;

first connecting means connecting said reservoir to one end of said coupling bar, said first connecting means including a rod pivotally connected to a lever;

a movable counterweight;

and second connecting means connecting said counterweight to the other end of said coupling bar.

2. An aerated grate covering device as claimed in claim 1 further comprising a manually operable lever, connected to said frame, for positioning said tabs on said frame, said lever providing said manual control over said grate covering device.

3. An aerated grate covering device as claimed in claim 1, wherein the number of the intermediate plates is related to the height of said baffle plate.

4. An aerated grate covering device as claimed in claim 1, further comprising a bushing disposed within each of said semitubular bases of said tabs, each of said bushings including a central shim adjusting ring nut, whereby said nut functions as a dripper for said semitubular bases.

5. An aerated grate covering device as claimed in claim 1 wherein said gutter frame comprises a double gutter frame having a central wall for supporting each of said semitubular bases.

6. An aerated grate covering device as claimed in claim 1 wherein said first and second connecting means further comprise tension rods connected to said coupling bar.

7. An aerated grate covering device as claimed in claim 1 further comprising means for automatically operating said device in response to strong winds, said wind responsive means including a support rotatably connected to said frame and said manually operable lever means, an aerodynamic plate pivotably carried on said support and a cable for connecting said aerodynamic plate to said manually operable lever and said frame.

8. An aerated grate covering device as claimed in claim 7 wherein said aerodynamic plate is in a first plane, said wind responsive means further comprising a plate in a second plane perpendicular to said first plane, said aerodynamic plate being pivotably mounted to said perpendicular plate.

* * * * *